US009782910B1

(12) United States Patent
Glaser

(10) Patent No.: US 9,782,910 B1
(45) Date of Patent: Oct. 10, 2017

(54) DIE PUNCH ASSEMBLY

(71) Applicant: Jeppe Group, LLC, Scottsdale, AZ (US)

(72) Inventor: Jeppe Glaser, Scottsdale, AZ (US)

(73) Assignee: JEPPE GROUP, LLC, Scottsdale, AZ (US)

( * ) Notice: Subject to any disclaimer, the term of this patent is extended or adjusted under 35 U.S.C. 154(b) by 136 days.

(21) Appl. No.: 14/823,794

(22) Filed: Aug. 11, 2015

(51) Int. Cl.

| | |
|---|---|
| ***B26D 5/08*** | (2006.01) |
| ***B26F 1/14*** | (2006.01) |
| ***B26D 5/10*** | (2006.01) |
| ***B26D 7/26*** | (2006.01) |

(52) U.S. Cl.
CPC ..... *B26F 1/14* (2013.01); *B26D 5/10* (2013.01); *B26D 7/2614* (2013.01)

(58) Field of Classification Search
CPC ..... B26D 5/10; B26D 7/2614; B26F 1/14
USPC ..... 83/520, 620, 669, 670, 673, 684, 685
See application file for complete search history.

(56) References Cited

U.S. PATENT DOCUMENTS

| | | | | |
|---|---|---|---|---|
| 5,601,006 | A | 2/1997 | Quinn et al. | |
| 6,089,137 | A * | 7/2000 | Lee | B26F 1/04 30/358 |
| 6,145,425 | A | 11/2000 | Bonnar et al. | |
| 6,752,058 | B2 | 6/2004 | Oh | |
| 7,464,480 | B2 | 12/2008 | Vetromila | |
| 8,381,623 | B2 | 2/2013 | Block et al. | |
| 2005/0199114 | A1 | 9/2005 | Tseng | |
| 2007/0068357 | A1 | 3/2007 | Marin | |
| 2008/0168877 | A1* | 7/2008 | Chan | B26F 1/14 83/685 |
| 2008/0223190 | A1* | 9/2008 | Bae | B26D 5/10 83/549 |
| 2009/0293694 | A1 | 12/2009 | Petersen et al. | |
| 2010/0257985 | A1 | 10/2010 | Hall | |
| 2011/0303068 | A1* | 12/2011 | Exley | B26F 1/04 83/698.21 |
| 2012/0011977 | A1 | 1/2012 | Singer et al. | |
| 2014/0165811 | A1* | 6/2014 | Lee | B26D 5/08 83/633 |

FOREIGN PATENT DOCUMENTS

| | | |
|---|---|---|
| EP | 1707327 | 4/2006 |
| WO | 2014029974 | 2/2014 |

* cited by examiner

*Primary Examiner* — Omar Flores Sanchez
(74) *Attorney, Agent, or Firm* — Booth Udall Fuller, PLC

(57) ABSTRACT

A die punch assembly includes a punch lid, a cutting die, a punch base, and an alignment stand. The punch lid includes a transparent lid window. The cutting die is coupled to the punch lid and includes a female portion and a male portion. The female portion includes a die base having an upper elevation, a die head, a die opening extending through the die base and die head, and a passage with at least two open sides between the die base and die head. The male portion is configured to slide through the die opening to cut material positioned within the passage. The punch base is coupled to the cutting die and includes a base opening aligned with the die opening. The alignment stand includes a top surface that is substantially planar with the upper elevation of the die base of the female portion of the cutting die.

13 Claims, 5 Drawing Sheets

DIE PUNCH ASSEMBLY

BACKGROUND

1. Technical Field

Aspects of this document relate generally to portable die punch assemblies.

2. Background Art

Die punch assemblies are regularly used in crafting and decorating to cut material in specifically desired shapes and sizes. Conventional die punch assemblies require a different cutting die to achieve a different size of cut material.

SUMMARY

According to one aspect, a die punch assembly comprises a punch lid, a cutting die, an alignment stand, and a punch base. The punch lid comprises a transparent lid window. The cutting die is coupled to the punch lid and comprises a female portion and a male portion. The female portion comprises a die base comprising an upper elevation, a die head, a die opening extending through the die base and die head, and a passage with at least two open sides between the die base and die head. The male portion is configured to slide through the die opening to cut material positioned within the passage and extending at least partially over the die opening. The punch base is coupled to the cutting die and comprises a base opening aligned with the die opening. The cutting die is positioned between the punch lid and the punch base. The alignment stand comprises a top surface that is substantially planar with the upper elevation of the die base of the female portion of the cutting die.

Various implementations and embodiments may comprise one or more of the following. The die opening may be substantially rectangular in shape and the male portion of the cutting die may be substantially rectangular in shape. The alignment stand may comprise at least one inner border that interfaces with at least one outer border of the punch base. The alignment stand may comprise two inner borders that interface with two outer borders of the punch base, and the at least two open sides of the passage may be aligned with the two outer borders of the punch base. The alignment stand may comprise a stand lip on each of the two inner borders, the stand lip interfacing the die base of the female portion of the cutting die and positioned at least partially between the die base and the die head of the female portion of the cutting die. One or more guide marks on the lid window, one or more guide marks on the alignment stand, and one or more guide marks on an inner surface of the male portion of the cutting die. The punch base may comprise one or more legs and the alignment stand may comprise one or more legs. The upper elevation of the die base may comprise a protruding lip surrounding the die base bordering the die opening.

According to another aspect, a die punch assembly comprises a punch lid, a cutting die, and a punch base. The punch lid comprises a transparent lid window. The cutting die is coupled to the punch lid, the cutting die comprising a substantially rectangular male portion and a female portion. The female portion comprises a die base comprising an upper elevation, a die head, a substantially rectangular die opening, and a passage positioned between the die base and the die head, the passage comprising at least two open sides. The male portion of the cutting die comprises an inner surface having one or more guide marks visible through the transparent lid window and configured to slide through the die opening and the passage to cut material positioned within the passage. The punch base is coupled to the punch lid and the female portion of the cutting die, the cutting die being positioned between the punch lid and the punch base and comprising a base opening extending through the punch base and aligned with the die opening of the female portion of the cutting die.

Various implementations and embodiments may comprise one or more of the following. An alignment stand comprising an inner border that interfaces with an outer border of the punch base and a top surface that is substantially planar with the upper elevation of the die base of female portion of the cutting die. The alignment stand may comprise two inner borders that interface with two outer borders of the punch base. The alignment stand may comprise a stand lip on each of the two inner borders, the stand lip interfacing the die base of the female portion of the cutting die and positioned at least partially between the die base and the die head of the female portion of the cutting die. One or more guide marks on the lid window and one or more guide marks on the alignment stand. The punch base may comprise one or more legs and the alignment stand may comprise one or more legs. The upper elevation of the die base may comprise a protruding lip surrounding the die base bordering the die opening.

According to another aspect, a die punch assembly comprises a punch lid, a cutting die, and a punch base. The punch lid comprises a viewing portion. The cutting die is coupled to the punch lid and comprises a substantially rectangular die opening aligned with the viewing portion of the punch lid. The punch base is coupled to the punch lid and the cutting die such that the cutting die is positioned between the punch base and the punch lid. The punch base comprises a base opening extending through the punch base and aligned with the die opening of the cutting die.

Various implementations and embodiments may comprise one or more of the following. The viewing portion of the punch lid may comprise a transparent lid window and the cutting die may comprise a substantially rectangular male portion and a female portion. The female portion may comprise a die base comprising an upper elevation, a die head, and a passage positioned between the die base and the die head. The passage may comprise at least two open sides. The male portion of the cutting die may comprise an inner surface having one or more guide marks visible through the transparent lid window and configured to slide through the die opening and the passage to cut material positioned within the passage. An alignment stand comprising an inner border that interfaces with an outer border of the punch base and a top surface that is substantially planar with the upper elevation of the die base of female portion of the cutting die. The alignment stand may comprise a stand lip on the inner border that interfaces the die base of the female portion of the cutting die and is positioned at least partially between the die base and the die head of the female portion of the cutting die. One or more guide marks on the lid window and one or more guide marks on the alignment stand. The punch base may comprise one or more legs and the alignment stand comprises one or more legs.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

The invention will hereinafter be described in conjunction with the appended drawings, where like designations denote like elements, and.

DESCRIPTION

This disclosure, its aspects and implementations, are not limited to the specific components or assembly procedures disclosed herein. Many additional components and assembly procedures known in the art consistent with the intended die punch assembly and/or assembly procedures for a die punch assembly will become apparent for use with implementations of die punch assemblies from this disclosure. Accordingly, for example, although particular punch lids, cutting dies, punch bases, and alignment stands are disclosed, such punch lids, cutting dies, punch bases, and alignment stands and implementing components may comprise any shape, size, style, type, model, version, measurement, concentration, material, quantity, and/or the like as is known in the art for such punch lids, cutting dies, punch bases, and alignment stands and implementing components, consistent with the intended operation of a die punch assembly.

Conventional die punch assemblies used for cutting material such as paper require a specifically sized die to cut a specifically sized shape. Thus, the cutting of varying sizes of shapes, such as a common squares or rectangles, requires a user to purchase a specific die for each desired size of cut. Contemplated in this disclosure is a die punch assembly that is configured to allow a user to cut variable sizes of shapes, such as squares and rectangles, with a single cutting die.

Figure 1:
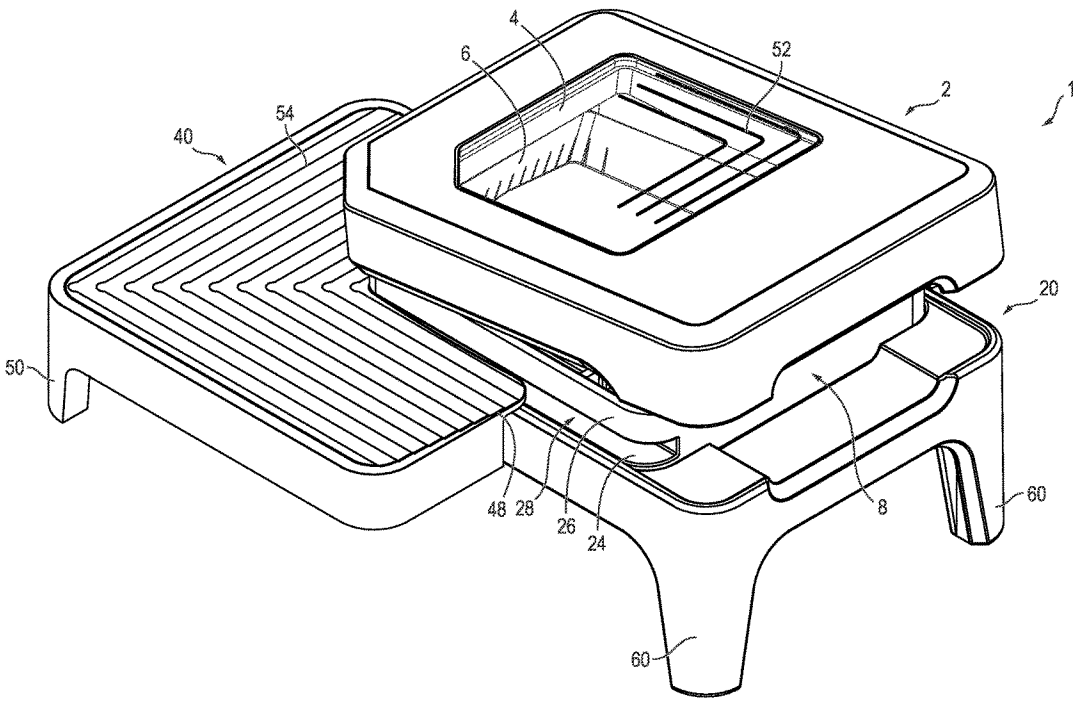
FIG. 1 is a perspective view of a die punch assembly with an alignment stand
Figure 2:
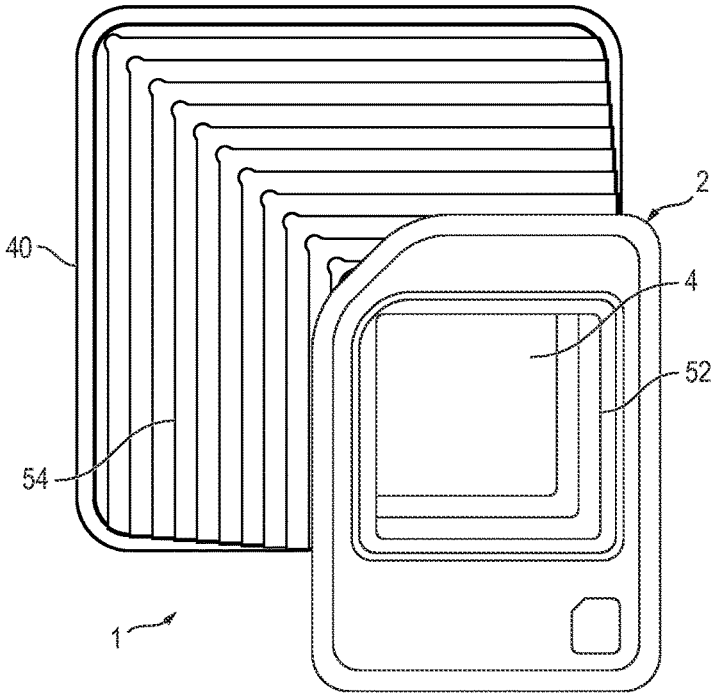
FIG. 2 is a top view of a die punch assembly with an alignment stand.
Figure 3A:
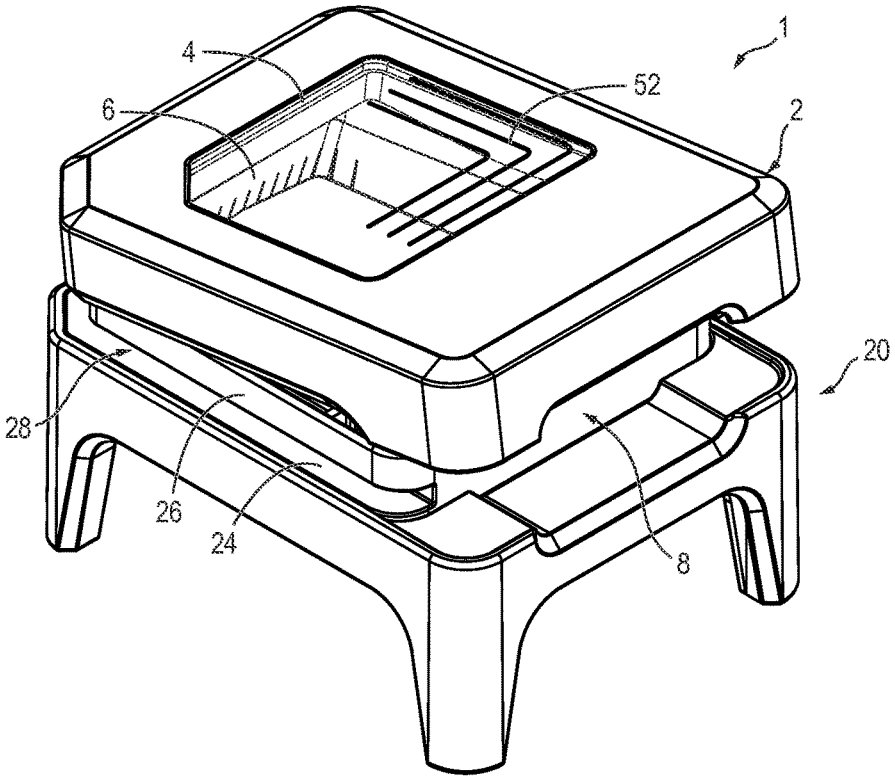
FIG. 3A is a rear perspective view of a die punch assembly.
Figure 3B:
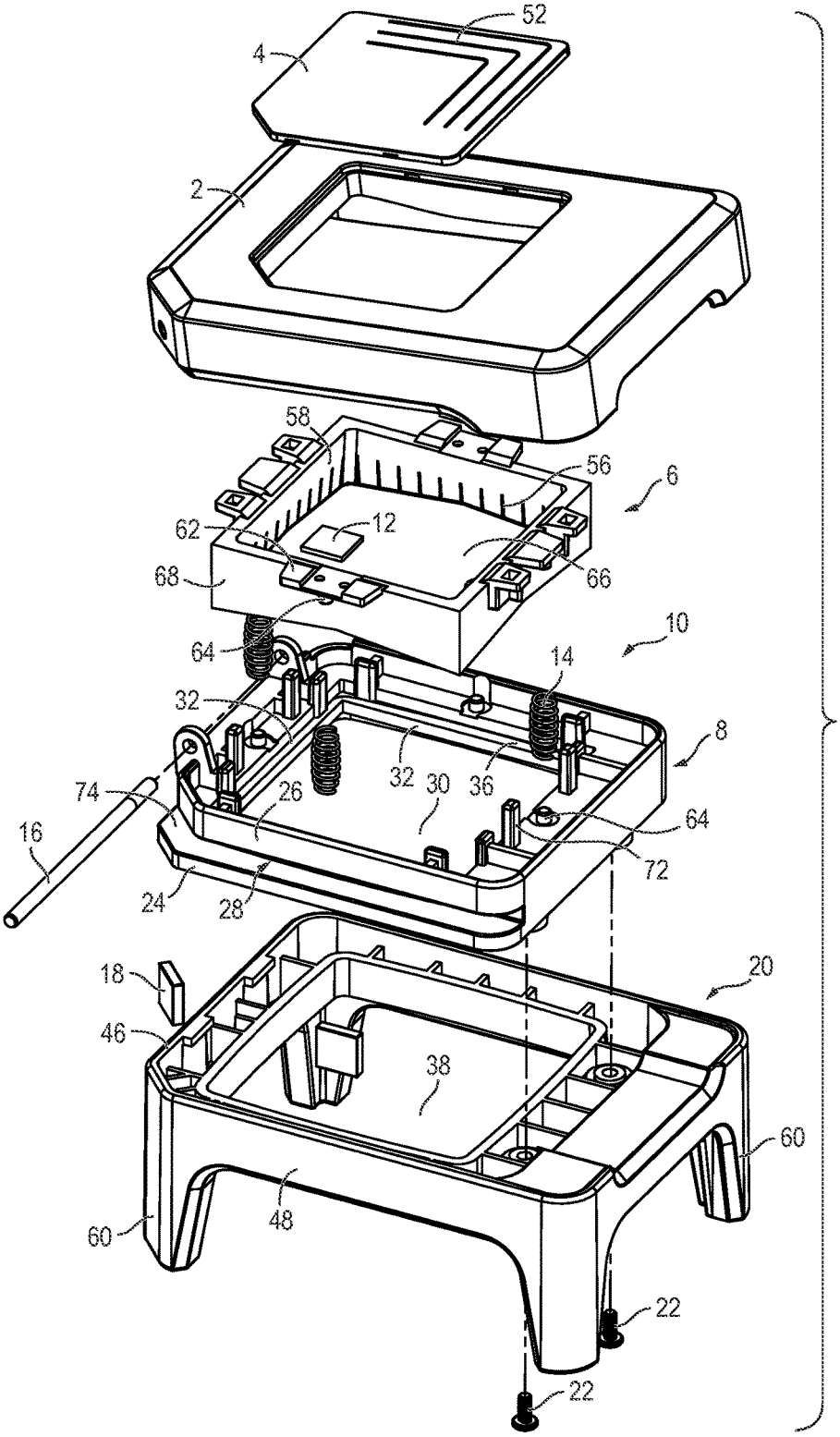
FIG. 3B is an exploded view of a die punch assembly.

In general, a die punch assembly 1 of this disclosure includes punch base 20, a cutting die, and a punch lid 2 having a viewing window portion. A non-limiting embodiment of a die punch assembly is depicted in FIGS. 1-3, with FIG. 3B providing an exploded view of a non-limiting embodiment of a die punch assembly 1. It will be understood that the contemplated disclosure is not limited to the particular embodiment shown for a punch base 20, cutting die 10, and punch lid 2 depicted in FIGS. 1-3, as other punch base, cutting die, and punch lid configurations and embodiments will be apparent to one of ordinary skill in the art upon review of this disclosure.

A die punch assembly 1 may comprise a punch lid 2 having a viewing window portion. In the non-limiting embodiment depicted in FIGS. 1-3, the viewing portion comprises a transparent lid window 4. It is contemplated that in other embodiments, the viewing portion may comprise any material that allows viewing within the die punch assembly 1 or, alternatively, may comprise an opening devoid of any material. In one or more embodiments, a transparent lid window 4 comprises at least one guide mark 52. In the non-limiting embodiment depicted in FIGS. 1-3, the transparent lid window 4 comprises a series of guide marks 52 increasing in size outward from a center of the transparent lid window 4. The guide marks 52 are positioned to allow a user to align a corner of a material inside the die punch assembly with a guide mark 52 on the transparent lid window 4 for a desired size of cut prior to cutting the material. In some embodiments, the guide marks 52 are right angle lines and may comprise units of measurement next to each guide mark 52.

The punch lid 2 may comprise any configuration that allows a user to press the punch lid 2 to actuate the cutting die 10. According to some aspects, a punch lid 2 is hingedly coupled to the cutting die 10. In such a configuration, a hinge pin 16 (shown in FIG. 3B) may hingedly couple the punch lid to the cutting die 10 and one or more springs 14 may bias the punch lid 2 away from a punch base 20 cutting die 10. As a user presses one end of the punch lid 2 opposite the hinge pin 16, the one or more springs 14 compress and the punch lid 2 pushes the male portion 6 of the cutting die 10 through the die opening 30 of the female portion 8. Upon release of the punch lid 2, the one or more springs 14 bias the punch lid away from the cutting die 10, and the male portion 6 slides away from the female portion 8 of the cutting die 10. Accordingly, a punch lid 2 may comprise any interior structural configuration to engage with tabs 62 or other elements of the male portion 6 when the punch lid 2 is pressed, such as but not limited to walls, bars, supports and the like.

As previously referenced, a die punch assembly 1 comprises a cutting die 10 coupled to a punch lid 2. More particularly, a punch lid 2 may be pivotally coupled to the cutting die 10. According to some aspects, a cutting die 10 comprises a male portion 6 and a female portion 8. The exploded view of FIG. 3B depicts a male portion 6 and a female portion 8 of a cutting die 10. In one or more embodiments, a punch lid 2 is pivotally coupled to a female portion 8 of a cutting die 10 with a hinge pin 16. A male portion 6 of a cutting die may be movably and biasedly coupled or mounted to a female portion 8 of a cutting die 10. In the non-limiting embodiment depicted in FIG. 3B, the male portion 6 is coupled or mounted to the female portion 8 with a plurality of springs 14. More particularly, the male portion 6 may be seated on a plurality of springs 14 positioned between tabs 62 on the male portion 6 and a die head 26 of the female portion 8. The tabs 62 and the die head 26 may comprise pins 64 positioned to hold the springs 16 in place between the tab 62 and the die head 26. Pressure pad inserts 12 may be positioned and/or coupled between the tabs 62 and the punch lid 2. Other embodiments may comprise other configurations known in the art for slidably and/or biasedly coupling a male portion 6 to a female portion 8.

A cutting die 10 according to some aspects comprises a die opening extending through cutting die 10 and aligned with the viewing portion of the punch lid 2 such that a user may view into the cutting die 10 through the viewing portion of the punch lid 2. More particularly, a die opening may extend through both a male portion 6 and a female portion 8 of a cutting die 10. In such embodiments, the male portion 6 may comprise a polygonal-shaped ring 58 having a first die opening 66 and the female portion 8 may comprise a second die opening 30 shaped complementary to the outer surface of the polygonal-shaped male portion 6. According to some aspects, the male portion 6 is substantially square or rectangular shaped on an outer perimeter 68 of the male portion of the cutting die 10 and the die opening 30 of the female portion 8 is complementary square or rectangle shaped such that the outer perimeter 68 of the male portion 6 interfaces with an inner perimeter of the die opening 30 of the female portion 8 as the male portion 6 slides through the die opening 30 of the female portion.

One or more embodiments of a male portion 6 of a cutting die comprise a plurality of guide marks 56. The guide marks 56 are positioned to allow a user to align material inside the die punch assembly 1 with a guide mark 56 for a desired size of cut prior to cutting the material. In some embodiments, units of measurement are positioned next to each guide mark 52.

A cutting die 10 may further comprise a female portion 8 coupled to the punch base 20, hingedly coupled to a punch lid 2 with one or more hinges and a hinge pin 16, and seated at least partially below a male portion 6 in a die punch assembly 1. A rear perspective view of a non-limiting embodiment of a female portion 8 of a cutting die 10 is shown in the exploded view of FIG. 3B. According to some aspects, a female portion 8 of a cutting die 10 comprises a die base 24, a die head 26, and a passage 28 extending between the die base 24 and the die head 26. The die base 24 may be coupled to the punch base 20 with one or more couplings such as screws 22. The passage 28 is sized to receive a material to be cut by the cutting die 10, such as but not limited to paper. The passage 28 comprises at least two open sides 32 that allow entrance of cutting material into the passage 28 for cutting by the cutting die 10. In the non-limiting embodiment depicted in FIG. 3B, the passage 28 comprises three open sides 32. The at least two open sides 32 of the passage 28 are typically positioned on the female portion 8 of the cutting die 10 to face the alignment stand 40. More particularly, at least two open sides 32 of the passage 28 are positioned proximate two outer borders 46 of a punch base 20 that interface two inner borders 42 of the alignment stand 40. This positioning allows for easy and convenient insertion of the cutting material in the punch die assembly 1 for measurement and cutting. The open sides 32 of the passage 28 may be sized large enough to receive cutting material but prevent entrance of other undesired objects, such as but not limited to fingers, wires, and the like. According to some aspects, the open sides 32 of the passage 28 are between 1/32" and 1/8". More particularly, the open sides 32 of the passage 28 may be approximately 1/16".

A die neck may extend between the die base 24 and the die head 26 to hold the respective elements in place. A die opening 30 of the female portion 8 extends through both the die head 26 and the die base 24 and is positionally aligned with the male portion 6 of the cutting die 10 as described above. As noted above, one or more pins 64 may extend from the die head 26 or elsewhere on the female portion 8 of the cutting die 10 to support or align the springs 14 for biased coupling of the male portion 6 to the female portion 8. Furthermore, the female portion 8 may comprise one or more hinges positioned to support the hinge pin 16 for hinged coupling of the cutting die 10 to the punch lid 2. The female portion 8 may further comprise one or more guides 72 positioned adjacent the die opening 30 and configured to guide or direct the male portion 6 of the cutting die 10 into the die opening 30 of the female portion 8.

Figure 5:
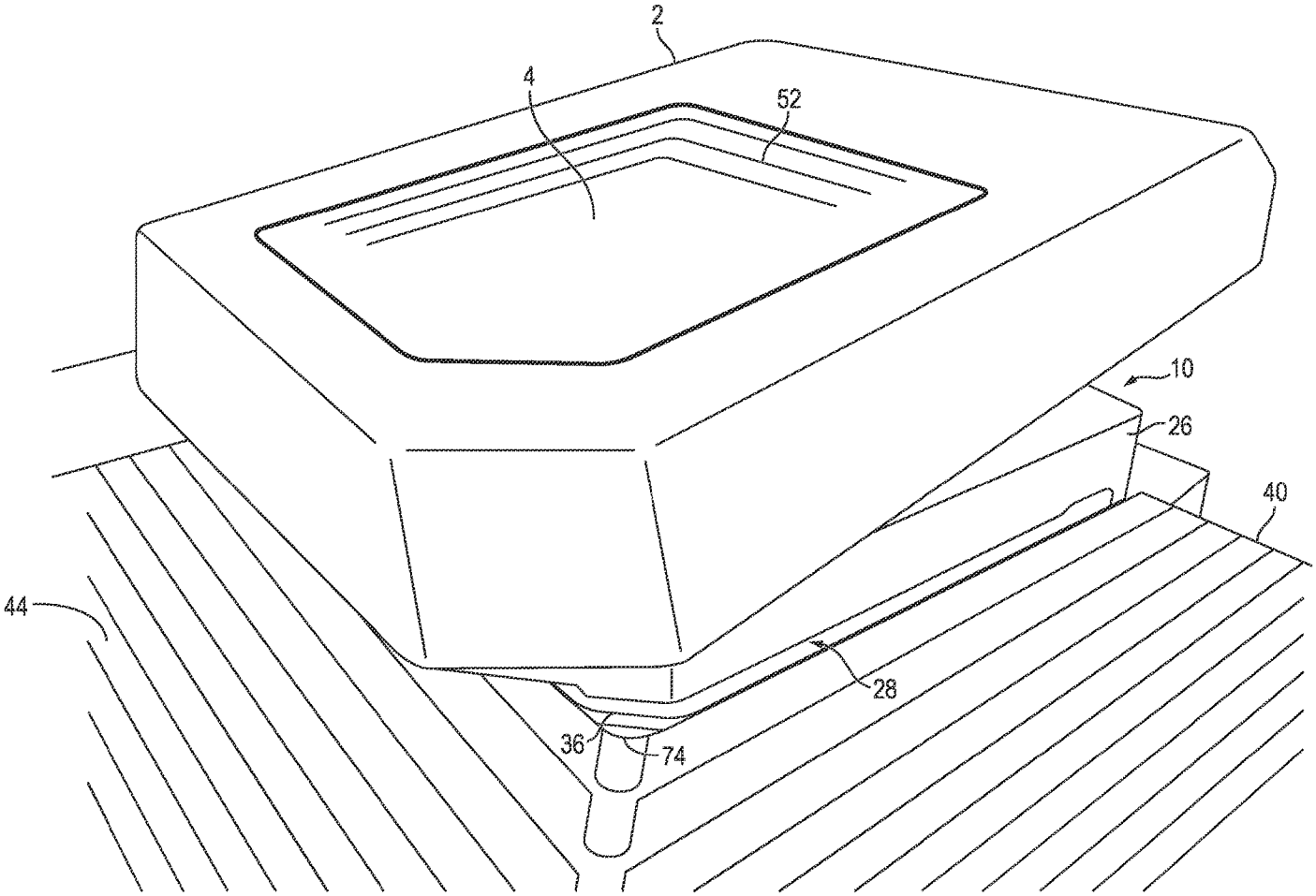
FIG. 5 is a front perspective view of a portion of a die punch assembly with an alignment stand.

A die base 24 is positioned opposite the die head 26 and may be coupled to the punch base 20. In other embodiments, a die base 24 forms the punch base 20 or is integral with the punch base 20. As previously referenced herein, a passage 28 is positioned between the die base 24 and the die head 26 of the female portion 8 of the cutting die 10. An upper elevation of the die base 24 may be substantially planar or level with the top surface 44 of the alignment stand 40 to provide the cleanest cut of material laying on the top surface 44 of the alignment stand 40 for cutting. In some embodiments, a top surface 74 of the die base 24 forms an upper elevation or plane of the die base 24. In other embodiments, a protruding lip 36 extends from the die base 24 towards the die head 26 to form an upper elevation or plane of the die base 24. The protruding lip 36 may be adjacent to and form a border around the die opening 30 extending through the die base 24. In such an embodiments, the top of the protruding lip 36 is substantially planar or level with the top surface 44 of the alignment stand 40. More particularly, the top surface of the die base may be sized and positioned to interface with and support a stand lip 48 on the alignment stand 40 that abuts the protruding lip 36 of the die base 24. FIG. 5 depicts a partial view of a non-limiting embodiment of an alignment stand 40 with a stand lip 48 resting on the top surface 74 of the die base 24 and abutting the protruding lip 36 of the die base 24. In this and other embodiments, the top of the protruding lip 36 forms an upper elevation of the die base 24 that is level with the top surface 44 of the alignment stand 40.

A punch base 20 may be coupled to a cutting die 10 or formed integrally with a cutting die 10. According to some aspects, a punch base 20 is coupled to the cutting die 10 with screws 22 or any other coupling known in the art. The punch base 20 comprises a base opening 38 aligned with the die opening 30 of the female portion 8 of the cutting die such that cut material falls through the base opening 38 in the punch base 20 after cutting by the cutting die 10. In one or more embodiments, a punch base 20 comprises at least one leg 60 that lifts a portion of the bunch base 20 above the ground surface and holds the cutting die 10 above the ground surface. The punch base 20 may further comprise one or more magnets 18 positioned to keep the punch base 20 and the cutting die 10 aligned during use. In other embodiments, the punch base 20 and the cutting die 10 may comprise one or more form-fitting features configured to keep the punch base 20 and the cutting die 10 aligned during use. In still other embodiments, the punch base 20 is formed integrally with the cutting die 10 or fixedly coupled to the cutting die 10. As previously referenced herein, a punch base 20 may comprise at least two outer borders 46 positioned to interface with at least two inner borders 42 of an alignment stand 40. In some embodiments, a punch base 20 comprises three outer borders 46 positioned to interface with three inner borders 42 of an alignment stand 40 such that the alignment stand 40 surrounds approximately 180 degrees of the die punch assembly 1.

Figure 4:
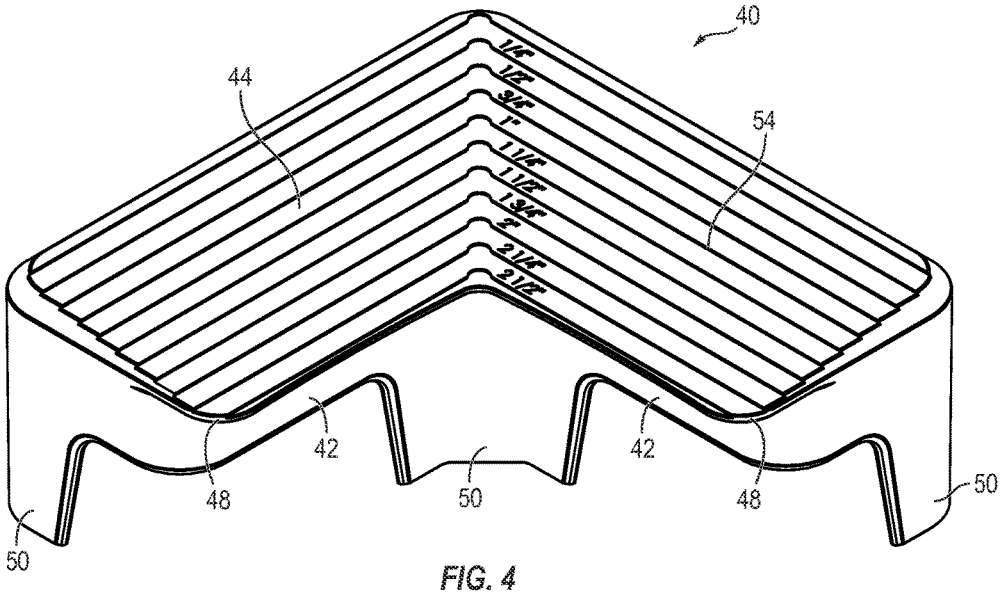
FIG. 4 is a perspective view of an alignment stand.

One or more embodiments of a die punch assembly 1 further comprise a separable alignment stand 40. An alignment stand 40 may be removably coupled to a punch base 20 of a die punch assembly 1 with magnets, pins, or any other coupling known in the art. FIG. 4 depicts a non-limiting embodiment of an alignment stand 40 separated from the rest of a die punch assembly, while FIGS. 1 and 2 depicts various views of a non-limiting embodiment of an alignment stand 40 positioned for use adjacent the rest of a die punch assembly 1. According to some aspects, an alignment stand 40 comprises a top surface 44 and one or more inner borders 42 configured to be positioned adjacent one or more outer borders 46 of a punch base 20 when in use. In the non-limiting embodiment depicted in FIGS. 1-3, the alignment stand 40 comprises two inner borders 42 configured to be adjacent two outer borders 46 of the punch base 20 when in use. In other embodiments, an alignment stand 40 comprises three inner borders 42 or other configuration that allows the alignment stand 40 to surround approximately 180 degrees of the punch base 20.

As previously referenced herein, an alignment stand 40 may be configured such that a top surface 44 of the alignment stand 40 is level or planar with an upper elevation of the die base 24 of the cutting die 10. Although not required in all embodiments, an alignment stand 40 may further comprise a stand lip 40 extending from the inner border 42 of the alignment stand 40. According to some aspects, the stand lip 40 is configured to overhang and/or interface with the upper elevation of the die base 24, as well as abut at least a portion of the protruding lip 36 (as shown in FIG. 5). With the top surface 44 of the alignment stand 40 level with the top surface 74 of the die base 24, the cutting die 10 may perform a cleaner cut on the cutting material.

The alignment stand 40 may further comprise one or more legs 50 positioned to hold the alignment stand 40 steady and sized to align the top surface 44 with the upper elevation of the die base 24. One or more embodiments of an alignment stand 40 comprise a plurality of guide marks 54. The guide marks 54 are positioned to allow a user to align material outside the die punch assembly 1 with a guide mark 54 for a desired size of cut prior to cutting the material. In some embodiments, units of measurement are positioned next to each guide mark 54.

In operation, a die punch assembly 1 may include one or more or any combination of the following acts. A method of cutting a material, such as paper, to a specific and unique size may comprise aligning an alignment stand 40 with a punch base 20. More specifically, a method may comprise aligning two or more inner borders 42 of an alignment stand 40 with two or more outer border 46 of a punch base 20. In some embodiments, a method comprises positioning a stand lip 42 of an alignment stand 40 to abut an upper elevation of a die base 24. The upper elevation may comprise either a top surface 74 of the die base 24 or a protruding lip 36 extending from the die base 24. When abutting an upper elevation of the die base 24, the top surface 44 of the alignment stand 40 and the upper elevation of the die base 24 are level or planar with one another.

A method may further comprise inserting a portion of a cutting material into a passage 28 of the cutting die 10 positioned between the die head 26 and the die base 24 of the female portion 8 of the cutting die. In some embodiments, a method comprises aligning the cutting material with one or more guide marks on the alignment stand 40, the male portion 6 of the cutting die 10, and/or the transparent lid window 4 of the punch lid 2. When aligning the cutting material for a desired cutting size, a user may view the cutting material within the cutting die 10 through the transparent lid window 4 of the punch lid 2, the die opening 66 of the male portion 6 of the cutting die 10, and the die opening 30 of the female portion of the cutting die 10. When the cutting material is in a desired position for a specific size of cut, a method comprises pressing the punch lid 2 to slide the male portion 6 of the cutting die 10 through the die opening 30 of the female portion 8 of the cutting die 10 to cut the material.

It will be understood that implementations are not limited to the specific components disclosed herein, as virtually any components consistent with the intended operation of a method and/or system implementation for die punch assemblies may be utilized. Accordingly, for example, although particular cutting dies, punch lids, punch bases, and alignment stands may be disclosed, such components may comprise any shape, size, style, type, model, version, class, grade, measurement, concentration, material, weight, quantity, and/or the like consistent with the intended operation of a method and/or system implementation for a die punch assembly may be used.

In places where the description above refers to particular implementations of a die punch assembly, it should be readily apparent that a number of modifications may be made without departing from the spirit thereof and that these implementations may be applied to other die punch assemblies. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

The invention claimed is:

1. A die punch assembly, comprising:

a punch lid comprising a transparent lid window;

a cutting die coupled to the punch lid, the cutting die comprising a female portion and a male portion, the female portion comprising a die base comprising an upper elevation, a die head, a die opening extending through the die base and die head, and a passage with at least two open sides between the die base and die head, and the male portion configured to slide through the die opening to cut material positioned within the passage and extending at least partially over the die opening;

a punch base coupled to the cutting die and comprising a base opening aligned with the die opening, the cutting die being positioned between the punch lid and the punch base; and an alignment stand comprising a top surface that is substantially planar with the upper elevation of the die base of the female portion of the cutting die;

wherein the die opening is substantially rectangular in shape and the male portion of the cutting die is substantially rectangular in shape, the alignment stand comprises at least one inner border that interfaces with at least one outer border of the punch base; and wherein the alignment stand comprises two inner borders that interface with two outer borders of the punch base, wherein the at least two open sides of the passage are aligned with the two outer borders of the punch base.

2. The die punch assembly of claim 1, wherein the alignment stand comprises a stand lip on each of the two inner borders, the stand lip interfacing the die base of the female portion of the cutting die and positioned at least partially between the die base and the die head of the female portion of the cutting die.

3. The die punch assembly of claim 1, further comprising one or more guide marks on the lid window, one or more guide marks on the alignment stand, and one or more guide marks on an inner surface of the male portion of the cutting die.

4. The die punch assembly of claim 1, wherein the punch base comprises one or more legs and the alignment stand comprises one or more legs.

5. The die punch assembly of claim 1, wherein the upper elevation of the die base comprises a protruding lip on the die base bordering the die opening.

6. A die punch assembly, comprising:

a punch lid comprising a transparent lid window;

a cutting die coupled to the punch lid, the cutting die comprising a substantially rectangular male portion and a female portion, the female portion comprising a die base comprising an upper elevation, a die head, a substantially rectangular die opening, and a passage positioned between the die base and the die head, the passage comprising at least two open sides, and the male portion of the cutting die comprising an inner surface having one or more guide marks visible through the transparent lid window and configured to slide through the die opening and the passage to cut material positioned within the passage;

a punch base coupled to the punch lid and the female portion of the cutting die, the cutting die being positioned between the punch lid and the punch base and comprising a base opening extending through the punch base and aligned with the die opening of the female portion of the cutting die; and an alignment stand comprising an inner border that interfaces with an outer border of the punch base and a top surface that is substantially planar with the upper elevation of the die base of the female portion of the cutting die;

wherein the alignment stand comprises two inner borders that interface with two outer borders of the punch base.

7. The die punch assembly of claim 6, wherein the alignment stand comprises a stand lip on each of the two inner borders, the stand lip interfacing the die base of the female portion of the cutting die and positioned at least partially between the die base and the die head of the female portion of the cutting die.

8. The die punch assembly of claim 6, further comprising one or more guide marks on the lid window and one or more guide marks on the alignment stand.

9. The die punch assembly of claim 6, wherein the punch base comprises one or more legs and the alignment stand comprises one or more legs.

10. The die punch assembly of claim 6, wherein the upper elevation of the die base comprises a protruding lip surrounding the die base bordering the die opening.

11. A die punch assembly, comprising:

a punch lid comprising a viewing portion;

a cutting die coupled to the punch lid, the cutting die comprising a substantially rectangular die opening aligned with the viewing portion of the punch lid; and a punch base coupled to the punch lid and the cutting die such that the cutting die is positioned between the punch base and the punch lid, the punch base comprising a base opening extending through the punch base and aligned with the die opening of the cutting die;

wherein the viewing portion of the punch lid comprises a transparent lid window and the cutting die comprises a substantially rectangular male portion and a female portion, the female portion comprising a die base comprising an upper elevation, a die head, and a passage positioned between the die base and the die head, the passage comprising at least two open sides, the male portion of the cutting die comprising an inner surface having one or more guide marks visible through the transparent lid window and configured to slide through the die opening and the passage to cut material positioned within the passage; and an alignment stand comprising an inner border that interfaces with an outer border of the punch base and a top surface that is substantially planar with the upper elevation of the die base of the female portion of the cutting die;

wherein the alignment stand comprises a stand lip on the inner border that interfaces the die base of the female portion of the cutting die and is positioned at least partially between the die base and the die head of the female portion of the cutting die.

12. The die punch assembly of claim 11, further comprising one or more guide marks on the lid window and one or more guide marks on the alignment stand.

13. The die punch assembly of claim 11, wherein the punch base comprises one or more legs and the alignment stand comprises one or more legs.

* * * * *